United States Patent [19]

Stephenson

[11] Patent Number: 4,682,459

[45] Date of Patent: Jul. 28, 1987

[54] FLOORING SYSTEM

[76] Inventor: Debra A. Stephenson, 210 Crystal Ave., Crystal Falls, Mich. 49920

[21] Appl. No.: 852,242

[22] Filed: Apr. 15, 1986

[51] Int. Cl.[4] ..... E04F 13/08

[52] U.S. Cl. ..... 52/390; 52/393

[58] Field of Search ..... 52/393, 408, 480, 390

[56] References Cited

U.S. PATENT DOCUMENTS

| | | | |
|---|---|---|---|
| 3,279,138 | 10/1966 | Dittmar | 52/390 X |
| 3,436,888 | 4/1969 | Ottosson | 52/480 |
| 3,440,787 | 4/1909 | Bataille | 52/480 X |
| 3,619,964 | 11/1971 | Passaro et al. | 52/393 X |
| 3,828,503 | 8/1974 | Hofmann | 52/390 X |
| 4,443,989 | 4/1984 | Silvey et al. | 52/480 X |
| 4,449,342 | 5/1984 | Abendroth | 52/393 |

FOREIGN PATENT DOCUMENTS

| | | | |
|---|---|---|---|
| 847342 | 6/1952 | Fed. Rep. of Germany | 52/393 |

*Primary Examiner*—William F. Pate, III
*Assistant Examiner*—Creighton Smith
*Attorney, Agent, or Firm*—Michael, Best & Friedrich

[57] ABSTRACT

A flooring system comprising a first substantially rigid layer overlying a foundation, a plurality of resilient pads disposed between the first layer and the foundation, a layer of resilient material overlying the first layer, a second substantially rigid layer overlying the resilient layer, a third substantially rigid layer overlying the second layer, and a floor board overlying the third layer.

18 Claims, 4 Drawing Figures

FLOORING SYSTEM

BACKGROUND OF THE INVENTION

This invention relates generally to flooring systems and, in particular, to flooring systems wherein alternate layers of rigid and resilient material are included.

Known flooring systems include various panel and sleeper systems wherein a plurality of cushioning pads, formed of rubber or similar material, resiliently support the floor slightly above a underlying concrete sub-floor foundation. Other known flooring systems include a single solid layer of cushioning material, such as cork, interposed between a plurality of overlying floorboards and an underlying concrete sub-floor foundation.

SUMMARY OF THE INVENTION

This invention provides a flooring system comprising a first substantially rigid layer overlying a foundation, a resilient pad disposed between the first layer and the foundation, a layer of resilient material overlying the first layer, a second substantially rigid layer overlying the resilient layer, a third substantially rigid layer overlying the second layer and a floorboard overlying the third layer.

The invention also provides a flooring system comprising a foundation, a first rigid layer including a plurality of elongate sheets arranged in a first plurality of parallel courses overlying the foundation, a plurality of resilient pads affixed to the first elongate sheets and disposed between the first rigid layer and the foundation, a layer of resilient material overlying the first rigid layer, a second rigid layer including a second plurality of rigid elongate sheets arranged in a second plurality of parallel courses over the resilient layer and arranged such that the second plurality of parallel courses is oriented in skewed relationship to the first parallel courses, a third rigid layer including a third plurality of elongate sheets arranged in a third plurality of parallel courses over the second rigid layer such that the third parallel courses are oriented in skewed relationship to each of the first and second parallel courses, and a plurality of floorboards overlying the third rigid layer.

In one embodiment, each of the first, second and third substantially rigid layers comprises a plurality of individual, substantially coplanar sheets.

In one embodiment adjacent coplanar ones of the individual sheets are spaced from one another such that limited displacement from coplanar alignment can occur among the sheets within the first, second and third rigid layers.

In one embodiment, a plurality of seams are formed between adjacent ones of the coplanar sheets and the coplanar sheets are oriented such that the seams in the second substantially rigid layer are skewed relative to the seams in the first rigid layer and such that the seams in the third rigid layer are skewed relative to the seams in the first and second layers.

In one embodiment, the resilient layer comprises a plurality of elongate strips oriented substantially perpendicularly to the seams in the first layer.

In one embodiment, each of the plurality of resilient pads is affixed to an individual one of the sheets in the first layer.

One of the principal features of the invention is the provision of a flooring system wherein substantially uniform resiliency is provided by a pair of cushioning layers and wherein strength and stability is provided by two or more relatively rigid layers disposed between and above the cushioning layers.

Another of the principal features of the invention is the provision of a flooring system having alternate layers of resilient and rigid material wherein each of the rigid layers is formed of a plurality of individual sheets oriented such that the seams between the individual sheets of a particular layer are skewed relative to the seams between the individual sheets in each of the remaining layers, whereby uniform floor resiliency is provided.

Another of the principal features of the invention is the provision of a flooring system wherein each of the sheets within one of the rigid layers is spaced from the adjacent sheets within the same layer to facilitate limited vertical displacement of individual sheets in response to the application of force on a limited area of the floor.

Other features and advantages of the invention will become apparent upon review of the following detailed description, drawings and claims.

Figure 1:
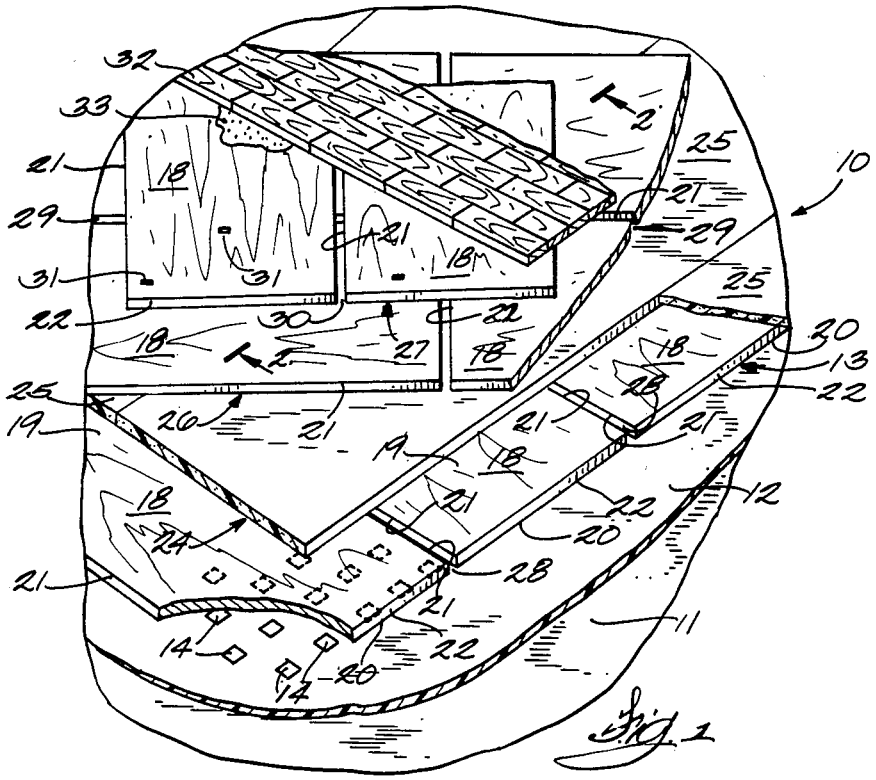
FIG. 1 is a partial perspective view of a portion of a flooring system which embodies various of the features of the invention.
Figure 2:
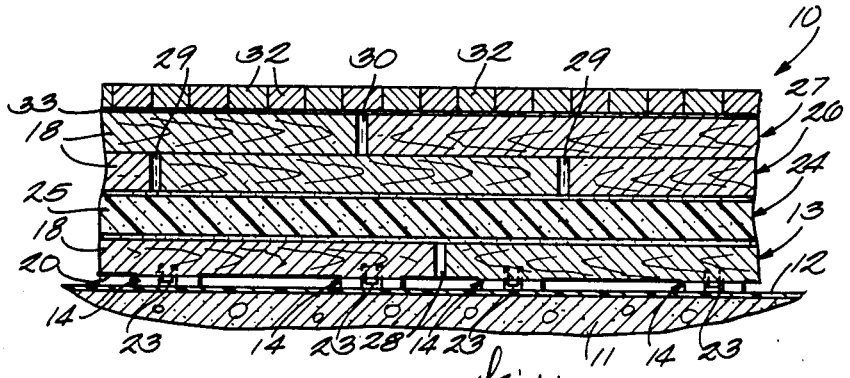
FIG. 2 is a cross-sectional view of the flooring system shown in FIG. 1 taken along line 2—2 thereof.

Before one embodiment of the invention is described in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and is not to be regarded as limiting.

DESCRIPTION OF THE PREFERRED EMBODIMENT

Referring to the drawings, and in particular to FIG. 1, a flooring system 10 is illustrated and is installed over a rigid foundation or slab 11 which comprises a concrete sub-floor which has been finished and leveled. To prevent the migration of moisture between the foundation 11 and the remainder of the flooring system, a vapor barrier 12 is disposed over the foundation 11. Preferably, the vapor barrier 12 is formed of six mil polyethylene, with four inch lap joints, covered with a felt membrane. It will be appreciated that other materials, such as two-ply, asphalt-saturated felt set in mastic, can also be used.

Figure 3:
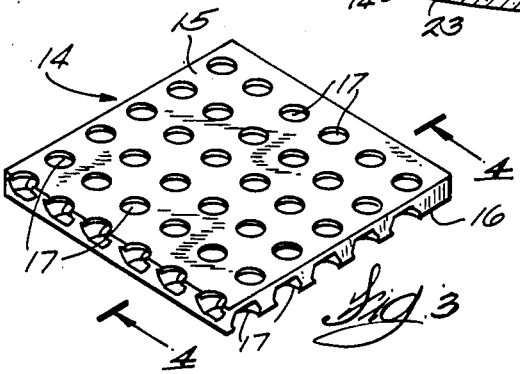
FIG. 3 is a perspective view of a resilient pad utilized in the flooring system shown in FIGS. 1 and 2.
Figure 4:
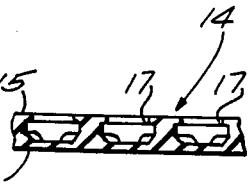
FIG. 4 is a partial cross-sectional view of the resiliant pad shown in FIG. 3 taken along line 4—4 thereof.

The flooring system 10 includes a first substantially rigid layer 13 overlying the vapor barrier 12 and the foundation 11. In order to provide uniform resilient and shock-absorbent qualities, the flooring system 10 further includes a plurality of resilient pads 14 which are disposed between the first rigid layer 13 and the vapor barrier 12 and which are spaced from one another in an open pattern. Although different materials and structures can be successfully used, in the illustrated embodiment, each of the resilient pads 14 comprises a substantially square section of substantially planar rubber sheeting having an upper surface 15, a lower surface 16 and an alternating open-cell structure as illustrated in FIGS. 3 and 4. Each pad 14 is approximately one-eighth inch thick and measures approximately $1\frac{3}{4}$ inches along each side A plurality of tapered, cylindrical, open-cells 17 are formed in both the upper surface 15 and lower surface 16 of each pad such that a resilient, cushioning structure results.

The first rigid layer 13 preferably comprises a plurality of elongate, generally rectangular, rigid sheets 18 formed of a wood-product material such as one of various types of plywoods, particle-boards, chip-boards, fiber-boards, press-boards, and the like. Each of the sheets 18 includes an upper surface 19, an undersurface 20, a pair of long edges 21, and a pair of short edges 22. Within the first rigid layer 13, the sheets 18 are arranged in a plurality of parallel courses and are preferably oriented such that the long edges 21 of each sheet lie substantially parallel to the long dimension of the area on which the flooring system is to be installed. To enhance the ease with which the flooring system can be installed, the resilient pads 14 are preferably fastened to the undersurfaces 20 of the overlying sheets 18 by means of a pluarality of staples 23 or similar fasteners. Preferably, the resiliant pads 14 are located at regular spaced intervals from one another along the undersurface 20 of each sheet. By way of example, sheets 18 can each measure four feet by eight feet in dimension and can include sixty resilient pads 14 mounted to the undersurface 20 on eight inch centers. It will be appreciated that other spacings and arrangements can be successfully utilized.

To provide an additional measure of resiliency and cushioning, flooring system 10 further includes a solid, substantially uniform layer of resilient material 24 overlying the first rigid layer 13. Although different materials and dimensions can be successfully utilized, the resilient layer 24 preferably comprises one-half inch thick, closed-cell polyethylene foam arranged in a series of edge-abutting elongate strips 25 laid directly over, and substantially perpendicularly to, the sheets 18 of the first rigid layer 13. Preferably, the elongate resilient strips 25 rest directly on the upper surfaces 19 of the underlying sheets 18 of the first rigid layer and no adhesive or other fastener is used between the resilient strips and the rigid sheets.

Flooring system 10 further includes a second substantially rigid layer 26 overlying the resilient layer 24, and a third substantially rigid layer 27 overlying the second rigid layer 26. Second and third rigid layers 26 and 27 are also each formed of a plurality of elongate, substantially rectangular, sheets 18 of a wood-product material such as plywood, chip-board, press-board, fiber-board, or particle-board, and can be indentical in dimension and composition to the sheets 18 of the first rigid layer 13. Within each of the rigid layers 13, 26 and 27, the sheets 18 are laid in a plurality of parallel courses and are arranged in edge-abutting, coplanar orientation such that respective pluralities of seams 28, 29 and 30 are formed between adjacent sheets and such that the seams 29 between the long edges 21 of the adjacent sheets in the second layer 26 are skewed relative to both the seams 28 between the long edges 21 of adjacent sheets in the first layer 13 and to the seams 30 between the long edges 21 of the adjacent sheets in the third rigid layer 27. In the illustrated embodiment, the seams 29 in the second rigid layer 26 are oriented at a substantially 45° angle to the seams 28 of the first layer 13, while the seams 30 in the third layer 27 are oriented so as to be oriented substantially perpendicularly to the seams 29 of the second layer 26. The sheets 18 are further arranged such that none of the seams 28, 29 or 30 in the layers 13, 26 or 27 is positioned directly over a parallel seam in any of the other layers. Preferably, the overlying sheets 18 of the second and third rigid layers 26 and 27 are joined to one another by means of a plurality of widely spaced (e.g. two-foot spacing) cleats or staples 31 driven through the third layer 27 into the second layer 26.

To enhance the uniformity of the resilient and shock absorbent qualities provided by the flooring system 10, adjacent ones of the individual sheets 18 within each of the first, second, and third rigid layers 13, 26 and 27 are spaced from one another such that limited vertical displacement from coplanar alignment can occur among the sheets 18 when localized pressure is exerted on isolated areas of the flooring system 10. In the example illustrated, each of the sheets 18, in each of the rigid layers 13, 26 and 27, is separated from an adjacent sheet by approximately one-quarter inch.

To provide a protective and decorative cover over the various layers, flooring system 10 includes a plurality of floorboards 32 arranged in end-abutting parallel courses over the top of the third rigid layer 27. In the illustrated embodiment, the floorboards consist of five-sixteenths inch thick parquet set in a bed of mastic 33 and oriented so as to lie substantially parallel to the long dimension of the area covered by the flooring system 10. It will be appreciated that other types of floorboards, such as nail strip flooring, and other fastening arrangements can be utilized instead.

After all of the courses of floorboards are laid, the flooring system 10 may then be finished by attaching moldings (not shown) to the perimeter of the floorboards to cover any perimeter voids.

Because the respective seams 28, 29 and 30 between adjacent sheets in each of the rigid layers 13, 26, and 27 are substantially skewed with respect to the seams of the remaining layers, flooring system 10 provides substantially uniform resiliency over its entire surface and is substantially free from "dead spots" or other such irregularities. Additionally, because flooring system 10 includes three separate rigid layers 13, 26 and 27 in combination with a solid resilient layer 24 and a layer formed of a plurality of individual, resilient pads 14 arranged in spaced relation to each other, considerable overall strength and lateral stability is provided in combination with double cushioning which makes the floor ideally suited for a variety of athletic activities including aerobic exercise, karate and various forms of dance. The structure of the floor, consisting primarily of relatively large individual sheets 18 and elongate strips 25, promotes relatively simple and rapid installation with a minimum of required labor.

Various of the features of the invention are set forth in the following claims.

I claim:

1. A flooring system comprising a foundation, a first substantially rigid layer including a plurality of elongate sheets arranged in a first plurality of parallel courses overlying said foundation, a plurality of resilient pads affixed to said first elongate sheets and disposed between said first rigid layer and said foundation, a layer of resilient material overlying said first rigid layer, a second substantially rigid layer including a second plurality of elongate sheets arranged in a second plurality of parallel courses over said resilient layer, a third substantially rigid layer including a third plurality of elongate sheets arranged in a third plurality of parallel courses over said second rigid layer, and a plurality of floorboards overlying said third rigid layer.

2. A flooring system in accordance with claim 1 wherein adjacent ones of said individual sheets are spaced from one another such that limited displacement can occur among said ones of said sheets within said first, said second and said third layers.

3. A flooring system in accordance with claim 1 wherein a plurality of seams are formed between adjacent ones of said sheets in each rigid layer and said sheets are oriented such that said seams in said second rigid layer are skewed relative to said seams in said first rigid layer and such that said seams in said third rigid layer are skewed relative to said seams in said first and said second layers.

4. A flooring system in accordance with claim 1 wherein said resilient layer comprises a plurality of elongate strips oriented substantially perpendicularly to said seams in said first layer.

5. A flooring system in accordance with claim 1 wherein said resilient pad is affixed to said first layer.

6. A flooring system in accordance with claim ·1 wherein a plurality of said resilient pads are disposed between said first layer and the foundation and said resilient pads are respectively affixed to the overlying one of said sheets in said first layer.

7. A flooring system comprising a foundation, a first rigid layer including a plurality of elongate sheets arranged in a first plurality of parallel courses overlying said foundation, a plurality of resilient pads affixed to said first elongate sheets and disposed between said first rigid layer and said foundation, a layer of resilient material overlying said first rigid layer, a second rigid layer including a second plurality of elongate sheets arranged in a second plurality of parallel courses over said resilient layer and arranged such that said second plurality of parallel courses is oriented in skewed relationship to said first parallel courses, a third rigid layer including a third plurality of elongate sheets arranged in a third plurality of parallel courses over said second rigid layer such that said third parallel courses are oriented in skewed relationship to each of said first and second parallel courses, and a plurality of floorboards overlying said third rigid layer.

8. A flooring system in accordance with claim 7 wherein said layer of resilient material comprises a plurality of elongate strips oriented substantially perpendicularly to said parallel courses of said first rigid layer.

9. A flooring system in accordance with claim 7 wherein, in each of said first, said second and said third rigid layers, said elongate sheets are spaced from one another so as to facilitate limited displacement relative to one another.

10. A flooring system in accordance with claim 9 wherein said sheets of said third substantially rigid layer are fastened to underlying sheets of said second substantially rigid layer.

11. A flooring system in accordance with claim 7 wherein said resilient pads are spaced from one another and are affixed to overlying sheets of said first rigid layer.

12. A flooring system comprising a founduation, a first substantially rigid layer comprising a plurality of first substantially rectangular elongate sheets each including an upper surface, an undersurface, a pair of long edges and a pair of short edges arranged in end to end alignment over said foundation such that said long edges of adjacent ones of said first sheets are co-linear with one another, a plurality of resilient pads affixed to said undersurfaces of said first sheets and disposed between said first sheets and said foundation, a resilient layer comprising a plurality of elongate strips of resilient material disposed over said first substantially rigid layer and arranged such that each of said strips is oriented substantially perpendicularly to said long edges of said first sheets, a second substantially rigid layer comprising a plurality of second substantially rectangular elongate sheets each including an upper surface, an undersurface, a pair of long edges and a pair of short edges arranged in end-to-end alignment over said resilient layer such that said long edges of adjacent ones of said second sheets are co-linear with one another and are skewed relative to said long edges of said first sheets, a third substantially rigid layer comprising a plurality of third substantially rectangular elongate sheets each including an upper surface, an undersurface, a pair of long edges and a pair of short edges arranged over said rigid layer in end-to-end alignment and oriented such that said long edges of adjacent ones of said third sheets are co-linear with one another and are skewed relative to said long edges of said first and second sheets, and a plurality of floor boards disposed over said third substantially rigid layer.

13. A flooring system in accordance with claim 12 wherein said first, said second and said third substantially rectangular sheets are formed of a wood-product material.

14. A flooring system in accordance with claim 12 wherein said layer of resilient material comprises a plurality of elongate strips of said resilient material oriented substantially perpendicularly to said long edges of said first sheets.

15. A flooring system in accordance with claim 12 wherein said resiliant material is polyethylene foam.

16. A flooring system in accordance with claim 12 wherein each of said resilient pads comprises an open-cell rubber pad.

17. A flooring system in accordance with claim 13 wherein said resilient material is polyethylene foam.

18. A flooring system in accordance with claim 17 wherein each of said resilient pads is an open-cell rubber pad.

* * * * *